United States Patent [19]

Graham

[11] 4,121,821

[45] Oct. 24, 1978

[54] SKATEBOARD RINK AND METHOD

[76] Inventor: Alton J. Graham, 181 W. 42nd St., Los Angeles, Calif. 90037

[21] Appl. No.: 781,152

[22] Filed: Mar. 25, 1977

[51] Int. Cl.[2] ..... A63K 1/00; A63G 7/00

[52] U.S. Cl. ..... 272/3; 104/63

[58] Field of Search ..... 272/3, 4, 5, 1 R, 2, 272/70, 70.3, 56.5 R, 56.5 SS; 104/63, 64, 67, 69, 73; 404/1; 280/87.04 A; 273/86 C; D25/1; D34/5 E, 5 F, 5 J, 5 KK, 14 C

[56] References Cited

U.S. PATENT DOCUMENTS

| | | | |
|---|---|---|---|
| D. 34,219 | 3/1901 | Morris | 104/63 X |
| D. 34,293 | 3/1901 | Morris | 104/63 X |
| D. 34,633 | 6/1901 | Morris | 104/63 X |
| D. 34,634 | 6/1901 | Morris | 104/63 X |
| D. 34,635 | 6/1901 | Morris | 104/63 X |
| 483,600 | 10/1892 | Butler | 272/5 |
| 577,549 | 2/1897 | Griffiths | 104/63 |
| 594,331 | 11/1897 | Crossley | 272/3 |
| 914,058 | 3/1909 | Martyne | 104/63 X |
| 1,571,434 | 2/1926 | Ray | 104/63 |

FOREIGN PATENT DOCUMENTS

| | | | |
|---|---|---|---|
| 380,575 | 9/1932 | United Kingdom | 272/1 R |

*Primary Examiner*—Richard C. Pinkham
*Assistant Examiner*—Arnold W. Kramer
*Attorney, Agent, or Firm*—John T. Matlago

[57] ABSTRACT

An amusement rink for skateboarders is formed by providing spaced mounds of earth on a substantially square, flat lot. A continuous riding track is provided which extends about the lot in a generally serpentine manner and passes over the mounds that it encounters as it progresses along its course, thereby providing a circuitous and undulating ride for the skateboarder.

10 Claims, 6 Drawing Figures

6
4
14
17
51
24
12
38
53
33
30
12
57
58
34
27
40
28
56
5
31
39
26
44
32
41
29
10
47
37
46
2

26
47
52
28
46
29
31
52
32
23
19
14
17
16

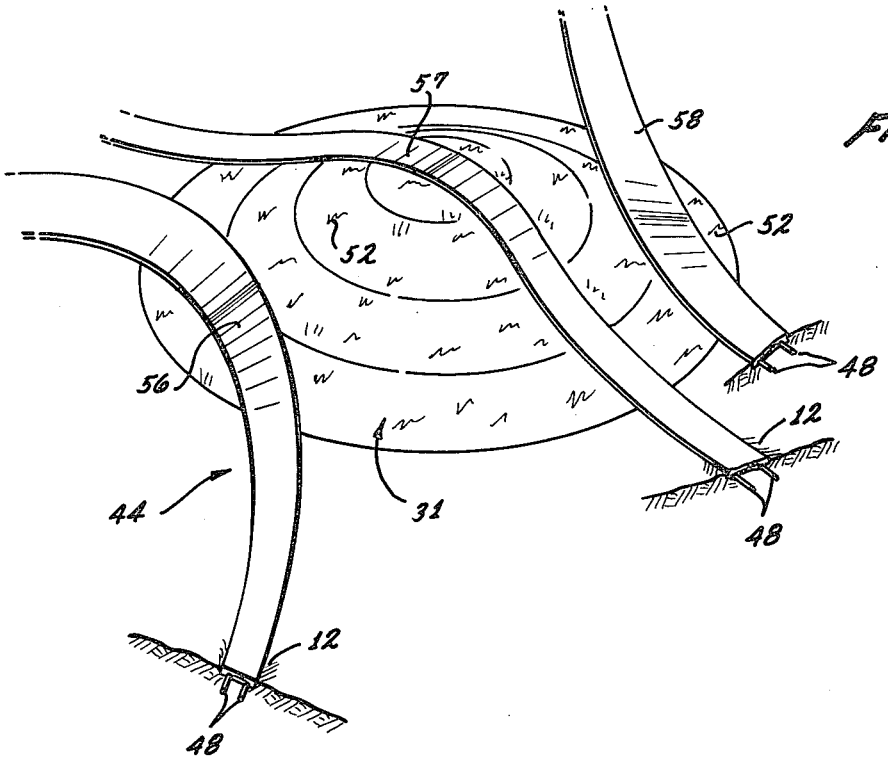
FIG. 3
FIG. 4
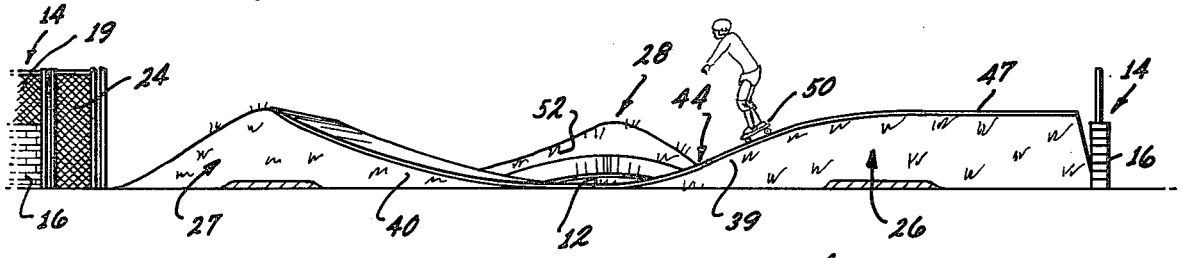
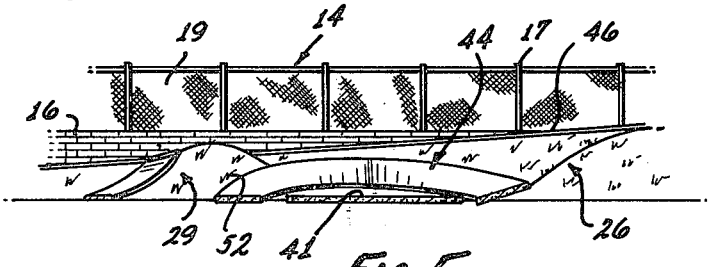
FIG. 5
FIG. 6
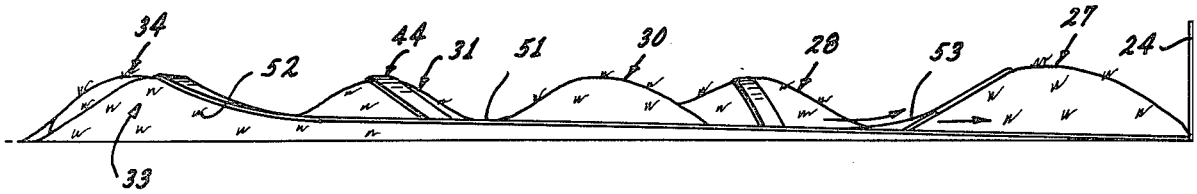

SKATEBOARD RINK AND METHOD

BACKGROUND OF THE INVENTION

This invention relates to amusement rinks and more particularly to a rink providing a track especially adapted for use by skateboard enthusiasts.

With the increasing interest in the sport of skateboarding manufacturers have provided skateboards on the market which are highly maneuverable and enable the skater to move at a high velocity. For lack of a better place to ride their skateboards, the advocates of this sport have used the public sidewalks and streets, and have even resorted to using the sides of empty swimming pools or drainage tunnels, for example. Inasmuch as these places are not generally reserved for such sport and have not been specifically designed for such use, they can create a safety hazard not only for the skateboarder but for the public. It is thus seen that there is a need to provide a skateboard rink having a specially designed track on which a person can safely skateboard without concern about creating a hazard for himself or others.

Accordingly, one of the objects of the present invention is to provide a rink for use by skateboard enthusiasts.

Another object of the present invention is to provide a skateboard rink that provides a sinuous and undulating track for the skateboarder.

Yet another object of the present invention is to provide an inexpensive skateboard rink.

Other objects and advantages of the invention will become more fully apparent from consideration of the following detailed description of the accompanying sheets of drawings which illustrate a preferred embodiment of the invention.

DRAWING SUMMARY

FIG. 3 is a perspective view of one of the circular mounds of earth showing portions of the continuous track passing over the sides thereof;

FIG. 4 is an elevation view of the end of the skateboard rink as taken along line 4—4 of FIG. 1;

FIG. 5 is an elevation view of the skateboard rink as taken along line 5—5 of FIG. 1; and FIG. 6 is an elevation view of the other side of the skateboard rink as taken along line 6—6 of FIG. 1.

PREFERRED EMBODIMENT

Figure 1:
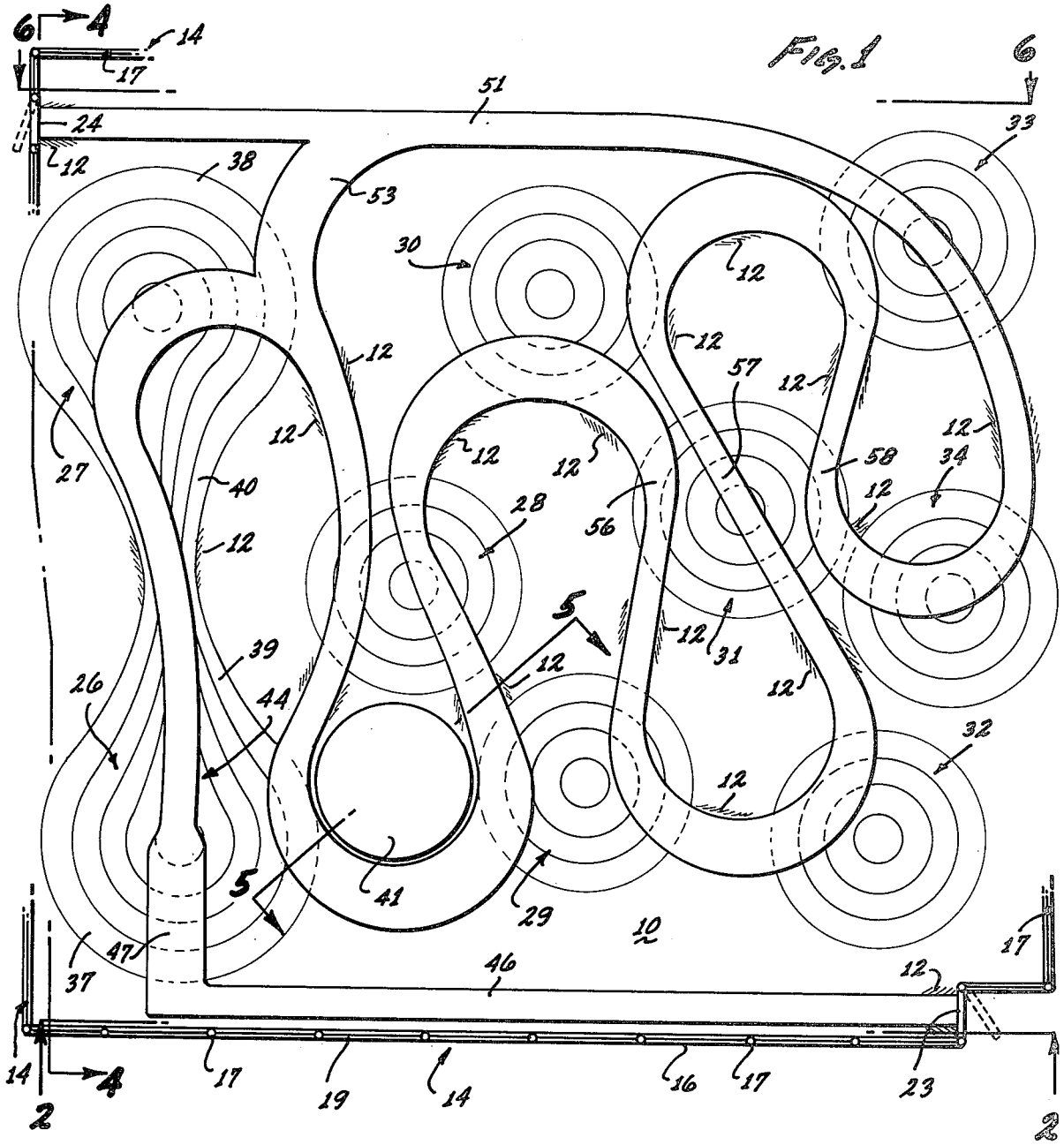
FIG. 1 is an overall plan view of the skateboard rink of the present invention.

Referring to the drawings, the skateboard rink embodying the features of the present invention is formed on a relatively flat substantially square lot 10 having a ground level bearing the reference numeral 12. By way of example only and without limitation, the lot 10 typically has an area of 2500 square feet. Some or all of the four sides of the lot 10 may be enclosed by a protective railing 14 which consists of a block wall 16 approximately 4 feet in height having spaced posts 17 mounted on the top thereof for supporting a 4 foot high chain link fence 19. An entrance gate 23 may be located on one corner and an exit gate 24 may be located on the diagonally opposite corner of the protective railing 14.

Placed in spaced relation about the lot 10 are nine mounds of packed earth bearing reference numerals 26 to 34, inclusive. Each of these mounds is illustrated by contour lines representing a 1 foot change in elevation or level.

The first two mounds 26 and 27 have generally pear-shaped overall contours and are placed along one end of the lot 10. Each of these mounds 26 and 27 has a circular portion 37 and 38, respectively, which may be on the order of 20 feet in diameter at the base and 5 foot in height above ground level 12. The tops of the circular portions of these first two mounds 26 and 27 are effectively joined together by elongated sloping portions 39 and 40 on respective adjacent sides thereof which meet at ground level 12 intermediate the mounds.

The remaining seven mounds of earth 28 to 34, inclusive, which are all generally circular in shape and smaller than the first two mounds 26 and 27 are placed in a somewhat randomly spaced relationship about the remaining area of the lot. Preferably each of these mounds 28 to 34 may be on the order of 16 feet in diameter at the base and 4 feet in height above ground level 12. In addition a flat competition ring 41 having a diameter on the order of 12 feet is provided on the lot 10 at ground level adjacent the first mound 26. A continuous riding track 44 formed preferably of concrete and having a smooth surface winds its way in a sepentine manner about the lot 10 with portions of the track along its length passing over the spaced mounds of earth.

Figure 2:
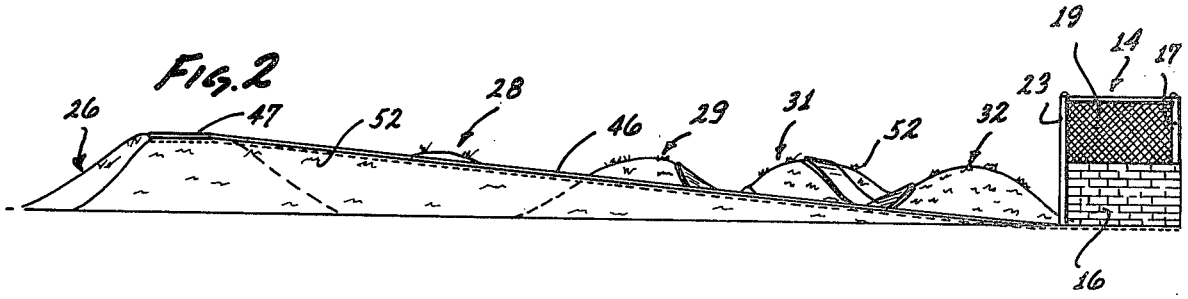
FIG. 2 is an elevation view of one side of skateboard rink as taken along line 2—2 of FIG. 1.

As shown in FIG. 2, extending within the protective railing 14 along the side of the lot 10 from the ground level 12 at the entrance gate 23 to the side of the first mound 26 is a long upwardly sloping ramp 46. Ramp 46 is formed of concrete and is approximately 3 feet wide. At a point opposite the top of the first mound 26 the ramp 46 merges onto a level rectangularly shaped concrete platform 47 which extends normal thereto. The platform 47 is about 5 feet wide and terminates at the top of the mound 26. This is the starting or push-off point for the skateboarder onto the track 44. The track is approximately 3 feet wide at its narrowest point and widens to as much as 5 feet or more as it banks around curves. As shown in FIG. 3, the track 44 may be formed of concrete on the order of 3 to 4 inches thick and reenforced with steel rods 48.

As illustrated in FIGS. 1 and 4, the track 44 extends from the platform 47 straight down the sloping portion 39 of the first mound 26 to ground level 12 and then continues on about half way up the sloping portion 40 on the side of the second mound 27 where it starts to curve up over and down the mound 27. It should be noted that the section of track 44 on the downwardly sloping portion 39 of the first or starting mound 26 provides the initial momentum for a person riding a skateboard 50. The section of track 44 on the upwardly sloping portion 40 of mound 27 together with the section of the track that curves over the top and down the side of the mound 27 serves to position the skateboarder to enter the remaining length of the track 44 which extends about the lot in a generally serpentine manner while passing over the sides of the circular mounds 28 to 34 encountered along its course. Thus upon circling down to ground level 12 from the upper surface of mound 27, the track 44 passes over the side of mound 28 at just above the 2 foot level and then returns again down to ground level 12. From there the track then curves substantially around the flat competition ring 41 while passing first over the side of the starting mound 26 at just above the 1 foot level and then passing over the side of the mound 29 at about the 2 foot level before returning back to ground level 12. It should be noted that the track 44 widens and is banked (FIG. 5) as it curves around the competition ring 41.

As the track leaves the vicinity of the competition ring 41, it again passes over the mound 28 but this time near the top thereof, i.e., at a higher level than before. The track then circles from ground level 12 and banks up over the side of the mound 30 at approximately a 2 foot level and down to ground level 12. The track then continues up over the side of mound 31 at about a 2 foot level and down to ground level 12 then up again over mound 29 at about a 3 foot level and down to ground level 12. The track then continues over the side of mound 32 at about a 3 foot level, down to ground level 12, then up over the center of mound 31, i.e., a 4 foot level, and then banks about the side of mound 30 at approximately a 1 foot level.

Upon again returning to ground level 12, the track continues circling around to extend over mound 33 at approximately a 2 foot level and upon reaching ground level continues on to run over mound 31 again at about a 2 foot level. The track 44 then circles about to pass over mound 34 near the top thereof and after reaching ground level 12 then passes up over mound 33 at approximately the top thereof.

As shown in FIGS. 1 and 6, the path of the track 44 straightens out upon leaving approximately the 2 foot level of mound 33 to form a long straight downwardly sloping exit ramp 51 that extends to the ground level 12 at exit gate 24. Prior to reaching the exit gate 24 a reentry section 53 of the track branches off from the exit ramp 51 and extends down over the lower end of mound 27 to merge into the beginning of the undulating length of track 44 to enable the skateboarder to repeat his ride if he so desires.

It should now be noted that the track 44 is preferably formed of concrete, for example, to provide a smooth, flat surface for skateboarding. Furthermore, the curves along the track are banked to minimize the risk of capsizing and to provide safety for the highest speed likely to be attained by the skateboarder.

It should be especially noted that the track curves around the lot with sections thereof extending at various levels over the sides of the mounds it encounters. Thus, as shown in FIGS. 1 and 3, a section 56 of the continuous track 44 runs over the surface of the mound 31 a first time at about a 2 foot level. The track then circles back later such that a section 57 thereof runs over the surface of the same mound 31 a second time at a 4 foot level. The track then circles back again still later such that a section 58 thereof runs over the surface of the same mound 31 a third time at about a 2 foot level.

It should now be further understood that the track tends to run in a serpentine manner from one side of the lot 10 to the other as it progresses to the far end of the lot. Thus each time the track heads toward a side of the lot, it substantially curves or loops back on itself so as to head toward the other side of the lot. Such an arrangement tends to compress or fold the track back on itself so that more crossings can be made from one side to the other on a given size lot and therefore enabling the overall length of the track to be quite long. Such an arrangement accordingly provides for efficiently utilizing a relatively small lot to provide a long and interesting ride for the skateboarder.

The areas of the mounds 26 to 34 and the lot 10 which are not covered by the track 44 and the competition ring 41 are preferably covered with grass 52.

It should now be clear that a skateboarder upon entering the entrance gate 23 of the rink walks or rides his skateboard 50 by pushing it up the entrance ramp 46 to the platform 47 on the top of the starting mound 26. There he pushes off on his skateboard 50 to ride down the section of the track 44 on the side sloped portion 39 of the starting mound to ground level 12. This initial momentum carries the skateboarder up the section of the track 44 on the side sloped portion 40 of the mound 27 where he curves up and about the top of mound 27 and down to ground level 12. From that point, the skateboarder receives a ride on the remainder of the track that not only follows a serpentine and sinuous path back and forth about the lot but which continually undulates between ground level 12 and higher levels as the track banks upon passing over the rounded surfaces of the mounds positioned along its path. Upon reaching the section of track 44 leading over the last mound 33, the skateboarder rides down the exit ramp 51 to the ground level at the exit gate 24, or if he so desires, he may take the branch reentry section 53 to repeat his ride along the length of undulating track.

It should be especially noted that, as the skateboarder rides along the length of track 44, each time he rides up the side of one of the mounds he returns back down to ground level 21, thus helping to regain his speed to aid him in riding up over the succeeding mound encountered along the path of track 44.

It should be further noted that the track 44 is designed so that once a skateboarder pushes off the platform 47 on the starting mound 27 he can ride the entire length of the track 44 without the need of again pushing his skateboard.

It should now be clear that the skateboard rink of the present invention enables the skateboarder to enjoy a fast and exciting ride along the track 44 which curves in a serpentine manner over the area of the lot while at the same time undulating over the sides of the various mounds encountered along its course.

From the above description it will be apparent that there is thus provided a device of the character described possessing the particular features of advantage previously enumerated as desirable but which obviously is susceptible of modification in its form, proportions, detail construction and arrangement of parts without departing from the principle involved or sacrificing any of its advantages. It is to be understood that the invention is not limited to the specific features shown but that the means and construction herein disclosed comprise the preferred form of several modes of putting the invention into effect, and the invention is therefore claimed in any of its forms or modifications within the legitimate and valid scope of the appended claims.

What is claimed is:

1. A skateboard rink comprising:

a substantially planar lot defining a ground level;

a plurality of spaced mounds in the form of substantially rounded cones having a generally randomly spaced relationship on said lot, at least one of said mounds being higher than the others and corresponding to a starting mound; and a continuous track for a skateboarder extending over said lot, said track being an elongated artificial surfacing which the skateboarder must follow, said track including a relatively straight section extending from the top of said starting mound down to ground level and curved sections passing from ground level over said other mounds at different height portions thereof and back down to ground level as the track continues along its course.

2. A skateboard rink as defined in claim 1 wherein said track further includes a section passing over a height portion of a mound and another section passing over another height portion of the same mound.

3. A skateboard rink as defined in claim 1 including a flat circular competition ring located on the ground level of said lot, said track including a section which substantially circles about said competition ring.

4. A skateboard rink as defined in claim 1 wherein said mounds are formed of earth.

5. A skateboard rink as defined in claim 1 wherein said artificial surfacing of the track is formed of concrete.

6. A skateboard rink as defined in claim 1 including an entrance ramp leading up to the top of the starting mound and an exit ramp leading away from the last mound passed over by said track.

7. A skateboard rink as defined in claim 6 including a track section branching from the exit ramp and leading back to the track at a point near its beginning.

8. A method of forming a skateboard rink comprising:

providing a substantially planar lot;

providing a plurality of mounds in the form of substantially rounded cones having a generally randomly spaced relationship on said lot; and forming a continuous substantially narrow riding track about said lot, said track being formed with an artificial surfacing which the user must follow, said track horizontally undulating between mounds and vertically undulating over differing height portions of the mounds.

9. A method of forming a skateboard rink in accordance with claim 8 including the step of forming a starting mound which is higher than the other mounds, the track starting at the top of said starting mound.

10. A method of forming a skateboard rink in accordance with claim 8 including the step of forming a gradually inclined entrance ramp extending from the level of the planar lot to the top of said starting mound.

* * * * *